US007806698B2

(12) United States Patent
Regnier

(10) Patent No.: US 7,806,698 B2
(45) Date of Patent: Oct. 5, 2010

(54) EDGE CARD CONNECTOR ASSEMBLY WITH HIGH-SPEED TERMINALS

(75) Inventor: Kent E. Regnier, Lombard, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 12/290,117

(22) Filed: Oct. 27, 2008

(65) Prior Publication Data

US 2009/0124128 A1 May 14, 2009

Related U.S. Application Data

(63) Continuation-in-part of application No. 11/176,515, filed on Jul. 7, 2005, now Pat. No. 7,585,188.

(60) Provisional application No. 60/586,126, filed on Jul. 7, 2004.

(51) Int. Cl.
*H01R 24/00* (2006.01)

(52) U.S. Cl. ..... 439/37

(58) Field of Classification Search ..... 439/637, 439/630, 59, 60, 631–635
See application file for complete search history.

(56) References Cited

U.S. PATENT DOCUMENTS 4,715,820 A * 12/1987 Andrews et al. ..... 439/59
4,780,095 A * 10/1988 Classon et al. ..... 439/637
6,394,823 B1 * 5/2002 Dunham et al. ..... 439/108

* cited by examiner

*Primary Examiner*—Alexander Gilman
(74) *Attorney, Agent, or Firm*—Stephen L. Sheldon

(57) ABSTRACT

A surface mount connector for high speed data transfer application has an insulative housing with a vertically-oriented circuit card-receiving slot disposed along a front face thereof. A plurality of conductive terminals are supported by the housing so that contact portions of the terminals extend into the card slot. The terminals are formed with a thin configuration to reduce the overall capacitance of the terminals as a group as a means of regulating the impedance thereof. The terminals are supported on opposing sidewalls of the connector housing and each of the terminals includes a tail portion, a contact portion and a retention portion that engages the connector housing so that the contact portions are cantilevered in their extent within the housing.

16 Claims, 11 Drawing Sheets

FIG.22
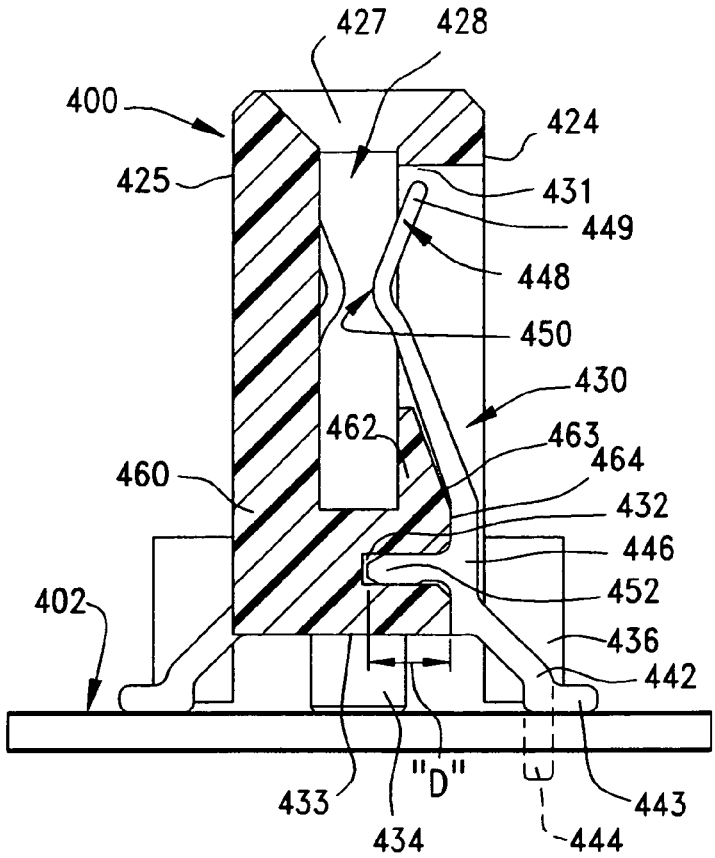
FIG.24
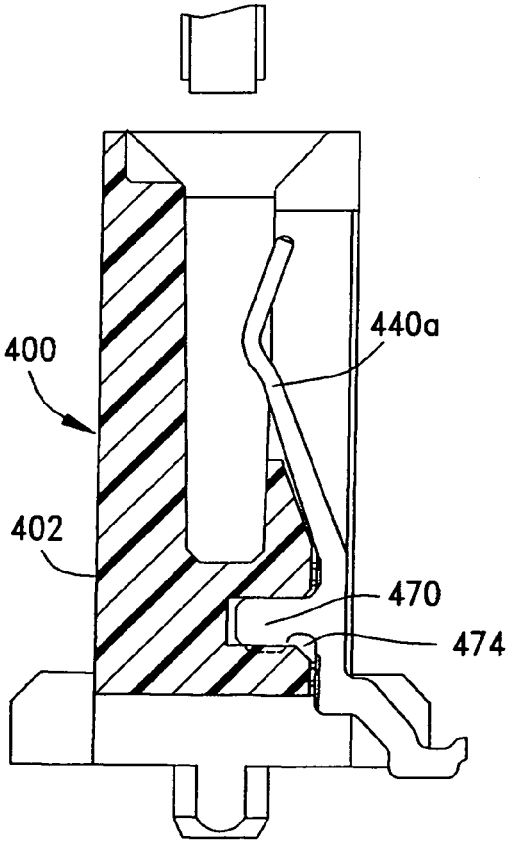
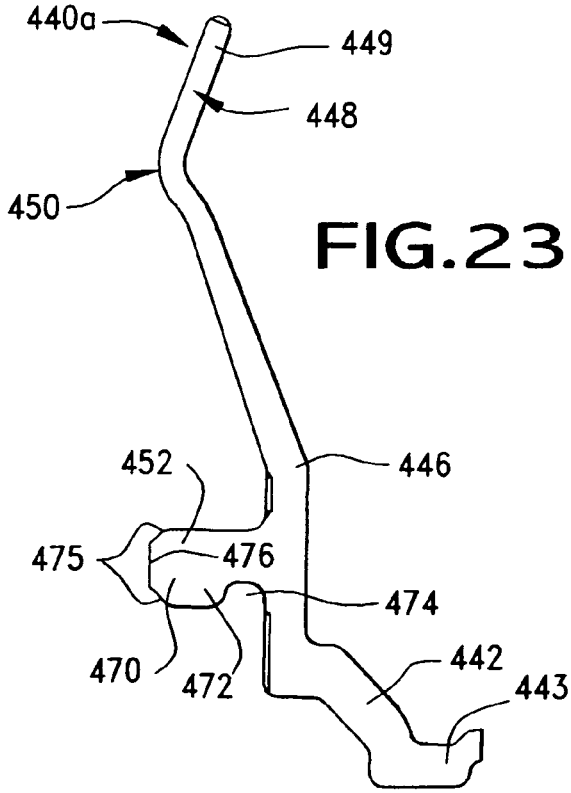
FIG.23

EDGE CARD CONNECTOR ASSEMBLY WITH HIGH-SPEED TERMINALS

REFERENCE TO RELATED APPLICATIONS

This application is a continuation-in-part application of prior U.S. patent application Ser. No. 11/176,515, filed Jul. 7, 2005 now U.S. Pat. No. 7,585,188, and it also claims priority from prior U.S. Provisional Patent Application No. 60/586,126, filed. Jul. 7, 2004.

BACKGROUND OF THE INVENTION

The present invention is directed generally to edge card connectors and, more specifically to edge card connectors in which the connector impedance may be controlled by shaping of the connector terminals.

High speed data transfer systems require electrical connectors in which the electrical impedance can be controlled in order to maintain the required data transfer rate of the electrical system. It is desirable at high speed data transfer rates to obtain a specific impedance in a connector that matches the impedance of the entire electronic system, i.e., the circuits on the a circuit board of an electronic device and either the circuits of opposing electronic device or in a transmission cable. The impedance of a connector may be controlled by the spacing of the terminals, the size of the terminals and the thickness and location of material within the connector housing.

However, low profile connectors, such as those used in SFP (Small Form Factor Pluggable) and SFP-like applications are desired in electronic devices in which space is a premium and thus it is difficult to control the impedance by modifying the spacing and size of the terminals in a reduced-size connector housing. When the structure of the terminals are modified, it becomes difficult to retain all of the mechanical functions of the connector, such as terminal retention and engagement while tuning the impedance of the connector. This terminal retention is especially important The present invention is directed to an improved electrical connector system that combines the aforementioned characteristics and which provides terminals that are capable of accommodating high data transfer speeds of approximately 2 gigabits per second and greater.

SUMMARY OF THE INVENTION

Accordingly, it is a general object of the present invention to provide a low profile connector in which the terminals may have varying shapes for controlling the impedance of the connector.

Another object of the present invention to provide a surface mount style connector for mounting on a circuit board, the connector having a plurality of conductive terminals supported therein in spaced apart order, the terminals having stubs and slots formed as part thereof, thereby reducing and/or increasing the amount of metal to influence the capacitance and/or the inductance of the terminals and control the impedance thereof.

A further object of the present invention is to provide a right angle, low profile surface mount connector for use in high speed applications in which the connectors have a specific structure for controlling the impedance and inductance of electrical connectors.

A still further object of the present invention is to provide a small form factor connector for receiving the edge of a circuit card therein and providing a connection between circuits on the circuit card and circuits on a larger circuit boards, the connector having an insulative housing having a slot disposed therein for receiving the edge of the circuit card therein, and the housing further having two terminal insertion faces disposed therein, each of the faces including a plurality of terminal-receiving slots, the terminal-receiving slots being disposed on opposite sides of the connector to facilitate insertion of the terminals therein.

Yet another object of the present invention is to provide a high speed connector of small form factor having an insulative housing and terminals supported by the housing along two opposing surfaces of the housing, each of the terminal including a contact portion that extends in a forward direction of the connector housing and a tail portion that extends in a rearward direction from the connector housing, each of the terminals further including a retention portion disposed intermediate the contact and tail portions thereof, the retention portion being received within individual retention cavities that extend transversely to the card-receiving slot.

Another object of the present invention is to provide a high speed connector having an insulative housing with defined top, bottom and side surfaces, the connector housing accommodating a plurality of conductive terminals that are inserted into terminal-receiving cavities disposed in the top and bottom surfaces of the connector housing, the bottom surface of the connector housing being recessed to define a recess between it and a top surface of a circuit board to which the connector housing may be mounted, the recess being sized sufficiently to receive a projection from an opposing mating connector to thereby provide a means for ensuring proper engagement between the connector housing and the opposing mating connector.

Yet a further object of the present invention is to provide a small size connector suitable for use in small form factor applications, the connector including a housing that supports a plurality of conductive terminals that are arranged in two distinct terminal sets on opposite surfaces of the connector, the terminal including surface mount feet that extend outwardly from the connector housing proximate a rear portion thereof, the terminal feet of one terminal set extending out from a first base portion of the connector housing and the terminal feet of another distinct terminal set extending out from a second base portion of the connector housing.

Still a further object of the present invention is to provide a small size connector for use in high speed data transmission applications, the connector having a slot for receiving a circuit card or a male portion of an opposing connector therein, the slot being flanked by a plurality of conductive terminals, each of the terminals including a retention member in the form of a stub that extends perpendicular to a body portion of the terminal, the stubs being sized to increase or decrease capacitance between adjacent terminals in order to firstly tune the impedance of the connector, the terminals being arranged in two distinct sets of terminals, one set of the terminals having their tail portions substantially disposed in the insulative housing of the connector and the other set of terminal having their tail portions substantially disposed in air, thereby creating two different sets of dielectric material that encompasses the terminal to secondly or further tune the impedance of the connector.

A yet still further object of the present invention is to provide a small footprint receptacle connector having a vertical configuration, the connector including a vertical housing and a circuit card-receiving slot formed therein, the connector housing including a plurality of spaced-apart vertical cavities arranged on opposite sides of the card-receiving slot, the cavities on one side of the connector housing being offset with the cavities on the other side of the housing, the cavities each receiving a single conductive terminal therein, each of the terminals having a contact portion, a body portion and a tail portion, the contact portion partially extending into the card-receiving slot, the tail portion extending out from the side of the connector housing for surface mounting to a base circuit board, and the body portion including a retention portion in the form of a stub member that extends out at an angle from the body portion, the stub portion being received within a corresponding cavity disposed beneath the card-receiving slot.

A further object of the present invention is to provide a vertically configured connector of the type described above, wherein each of the terminal-receiving cavities includes an internal support shoulder having an angled surface that opposes the terminal body portion.

The present invention accomplishes the aforementioned and other objects by the way of its novel and unique structure. In one embodiment of the invention, a connector assembly is provided for mounting to a circuit board with surface mount technology. The connector includes a dielectric housing and terminals of a first type which are stamped from a metal strip and are inserted into slots in a front face of the connector housing. Terminals of a second type are stamped from a second metal strip and are inserted into slots along the rear face of the connector housing so the first and second type terminals are opposing each other. The first and second sets of terminals are inserted into the connector housing along two distinct faces of the housing, which are preferably on opposite ends, or sides of the housing.

The first and second type terminals have cantilevered contact arm portions that at least partially extend into an internal receptacle of the connector housing which is designed to receive the edge of a circuit card. Both the first and second types of terminals have contact portions, tail portions and interconnecting body portions. The terminal body portions also include terminal retention portions that are press fit into slots, or other cavities, that are formed in the connector housing. The terminals are inserted into the connector housing from two opposite sides of the housing, preferably the top and bottom sides of the housing. Using this connector housing structure, the terminal may be reduced in size, yet still maintain their overall cantilevered configuration. The tail portions of the terminals of this embodiment include surface mount feet that preferably extend at an angle so that they are oriented parallel to the circuit board. The terminals may also include through hole tails that extend at an angle to the circuit board.

Each terminal include a contact portion and a body portion that extends between the contact and tail portions. The terminals are received in terminal-receiving cavities that extend lengthwise through the connector housing in a staggered arrangement so that the terminals of one of the two distinct terminal sets are staggered with respect to the other of the two distinct terminal sets. The terminal body portions further include retention portions that preferably take the form of stubs that extend out at an angle to the body portions and the stubs are received within slots that extend at an angle, preferably inwardly of the connector housing, to the main terminal-receiving cavities of the connector housing.

The connector housing of the invention may include two distinct base portions which are spaced lengthwise apart from each other. Each of these base portions preferably supports a single set of terminals near the tail portions thereof. With this arrangement, the bottom of the connector housing may be hollowed out to form a recess that opens to the front of the connector and which is closed off by one of the two base portions at the rear of the recess. This recess is configured to receive a projection from an opposing mating connector in the form of a plug connector. This recess permits a user to ensure that the opposing mating connector will be properly inserted into and mated with the connectors of the invention. This recess does not reduce the overall structural integrity of the connectors of the invention and the location of the slots that receive the retention members also does not reduce the structural integrity of the connectors of the invention.

The two distinct base portions serve to locate the tails of the two sets of terminals in different locations. The tails of one set of terminals are positioned inwardly of a rear edge of the connector housing, while the tails of the other set of terminals are positioned proximate to the rear edge of the connector housing. The tails of the one terminal set are substantially enclosed with the material that makes up the connector housing while the tails of the other terminal set are supported mostly in air, thereby providing two different dielectric materials that enclose the terminal tail portions to thereby tune the impedance of the connector along the tail portion area thereof.

In the vertical embodiment of the present invention, a vertical connector housing is provided with top and bottom surfaces, and a pair of opposing end walls and a pair of opposing sidewalls that interconnect the end walls together. The top surface of the connector housing is provided with a slot therein. This slot is intended to receive the mating end of a circuit card that is typically held by an opposing plug-style connector. The slot extends vertically within a body portion of the connector housing and ends a sufficient distance away from the bottom surface so as to define an area that may engage retention portions of associated terminals.

A plurality of conductive terminals are supported in a like plurality of cavities that are also formed in the connector housing. These terminal-receiving cavities are arranged in two arrays, with a first array disposed along one side wall of the connector housing and with the second array disposed along the other, and opposite side wall of the connector housing. The first and second arrays are offset from each other in the preferred execution of the vertical embodiment, and each such cavity contains a single terminal. In this manner, the terminals of one array are offset from the terminals of the other array in order to preserve the structural strength of the connector housing.

The cavities communicate with the card-receiving slot so that the terminal contact portions extend into the slot for contacting a circuit card inserted into the slot. The cavities may also include reaction surfaces that are angled with respect to the card-receiving slot and which limit the inward extent of travel of the terminals into the card-receiving slot. These reaction surfaces define L-shaped portions that have greater strength to retain the terminals in place within the connector housing. Retention recesses, or secondary slots, also may be formed in the body of the connector housing at an angle to the terminal-receiving cavities, and preferably at right angles thereto in order to receive retention portions of the terminals.

The terminals are provided with contact portions, tail portions and body portions that interconnect the contact and tail portions together. Retention members, which preferably take the form of stubs, extend out at an angle to the body portions, and these stubs preferably extend out at a right angle. They are received in recesses that are disposed in the connector housing beneath the card-receiving slot. The stubs may have edges that are larger than the recesses they are received in so as to effect an interference fit in the recesses such as by skiving. A portion of the stub may be narrowed in its width so as to reduce the contact area with the lower portion of the connector housing with minimal effect of the impedance of the connector These and other objects, features and advantages of the present invention will be clearly understood through a consideration of the following detailed description.

BRIEF DESCRIPTION OF THE DRAWINGS

In the course of this detailed description, the reference will be frequently made to the attached drawings in which:

FIG. 22 is a vertical sectional view of the connector of FIG. 19;

FIG. 23 is a plan view of another form of a terminal used in the vertical connectors of the invention; and, FIG. 24 is a sectional view of a vertical connector of the invention utilizing a terminal of FIG. 23.

DETAILED DESCRIPTION OF THE PREFERRED EMBODIMENTS

Figure 1:
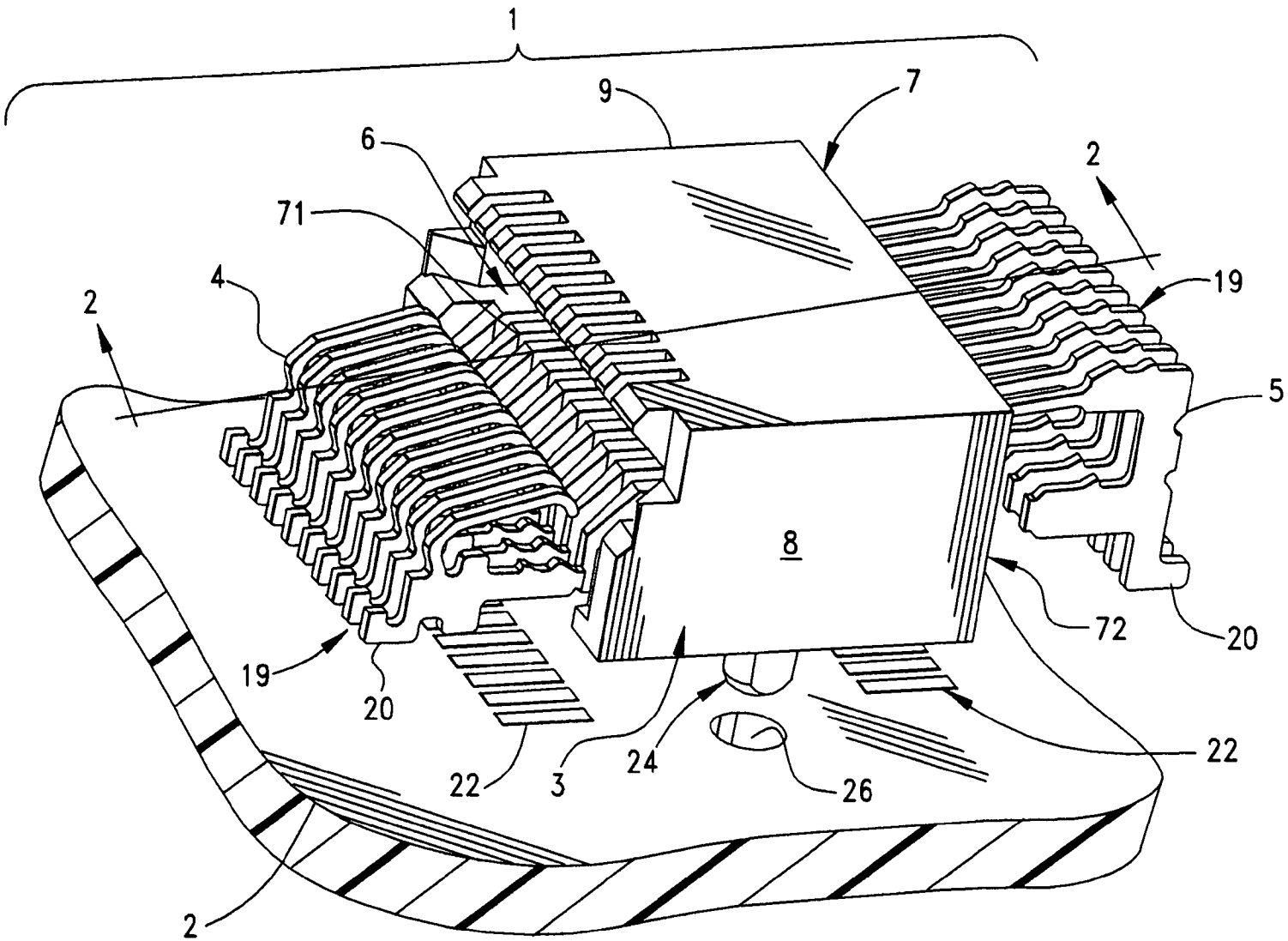
FIG. 1 (PRIOR ART)
FIG. 1 is an exploded perspective view of a known connector assembly illustrating one type of circuit board application to which the present invention is directed.

FIG. 1 illustrates a known connector assembly, generally designated as 1, that will be used to explain the environment in which the present invention operates. The connector assembly 1 is a surface-mount style and is intended for mounting to a printed circuit board 2. The connector assembly includes an insulative housing 3, preferably formed from a dielectric material, and a plurality of conductive terminals 19 are supported in the housing 3. The terminals 19 are arranged in two distinct sets of first terminals 4 and second terminals 5. The connector housing preferably has a configuration which includes a plurality of distinct faces and these faces include a first, or front face 6 and an opposing second, or rear face, 7. Side faces or sidewalls 8, 9 are seen to interconnect the front and rear faces 6, 7 of the housing together, and in the embodiment illustrated, the housing. The first (front) face 6 of the connector housing may be considered as a mating face of the connector inasmuch as it contains a slot formed therein for receiving an edge of a circuit board or edge card therein, and the second face 7 of the connector housing is opposed to the front face. The second or rear face 7 is disposed adjacent a mounting face, i.e., the bottom of the connector housing that lies upon the circuit board 2.

The first terminals 4 are mounted into slots 71 formed in the connector housing 3 along its front face 6, while the second terminals 5 are mounted in slots 72 that are formed in the connector housing 3 along its rear face 7. The front and rear faces 6, 7 are oriented substantially perpendicular to the printed circuit board 2 onto which the connector housing 3 is mounted. Mounting portions 20 formed in the terminals 19 are located on the terminals 19 in locations spaced away from the connector housing 3 and serve as a means for connecting the terminals of the connector to corresponding conductive pads 22 formed with the circuit board 2 in a surface mount manner. These mounting portions are illustrated as conventional surface mount tails. The connector housing 3 may also include mounting pegs, or posts 24 formed therewith that are received within complementary openings 26 formed with the circuit board 2.

Figure 2:
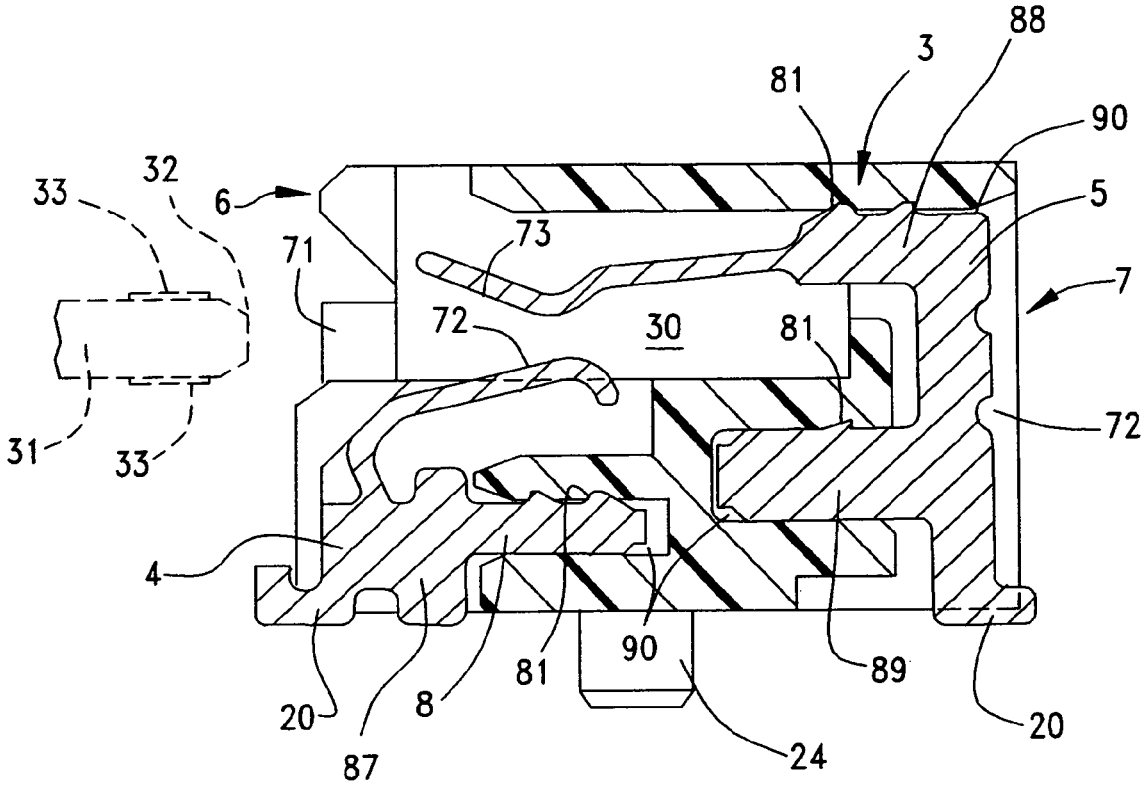
FIG.2 (PRIOR ART)
FIG. 2 is a cross-sectional view of the connector assembly of FIG. 1 taken along line 2-2 thereof, removed from the circuit board and illustrating the housing, its mating slot and the positioning of first and second terminals therein.

FIG. 2 illustrates, in cross-section, the connector housing 3 of FIG. 1. This view shows the position of the two sets of terminals 4, 5. The connector housing 3 includes an internal cavity, or receptacle 30, which receives an insertion edge 32 of an edge card 31, illustrated in phantom. The two terminals 4, 5 each have contact arm portions 72, 73 that extend in a cantilevered fashion, from body portions 87, 88, into the internal receptacle 30 along opposite sides thereof in opposition to circuit pads 33 arranged on the circuit card 31. The terminals 4, 5 may also include terminal retention portions 8, 88 & 89 which may or may not form part of the terminal body portions. These retention portions include one or more teeth or barbs, 81, that skive, or cut, into the connector housing material along the edges of the three retention slots 90 which are shown in the Figure.

Figure 3:
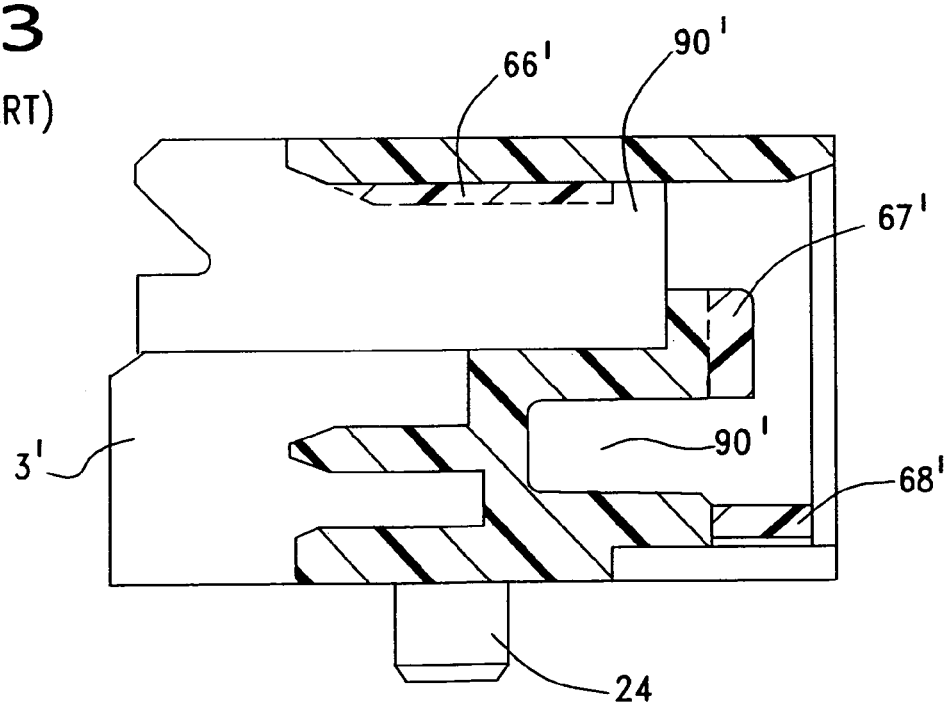
FIG.3 (PRIOR ART)
FIG. 3 is a cross-sectional view of a known connector housing.
Figure 4:
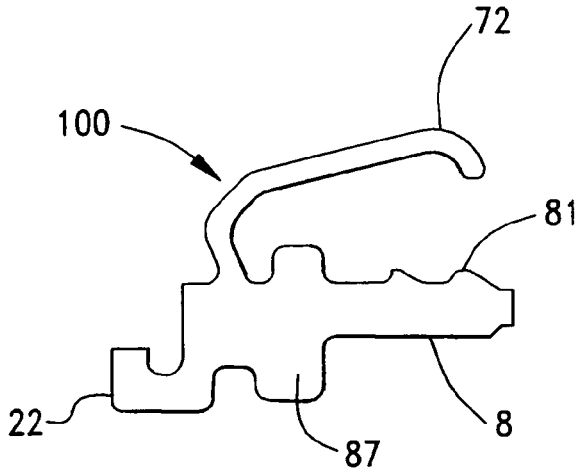
FIG.4 (PRIOR ART)
FIG. 4 is a side elevational view of a first type terminal utilized in the known connector assembly of FIG. 1.

FIG. 4 illustrates, a first type of terminal 100 that is used in the known connectors of FIG. 3. This terminal 100 is seen to have a surface mount portion 22, an elongated, cantilevered contact portion 72 that extends into a card-receiving slot of the connector, a body portion 87, and a terminal retention portion 8 that is received within a slot or cavity formed in the connector housing. Barbs 81 are provided as part of the terminal retention portion 8 to increase the retention of the terminal in the connector housing.

Figure 5:
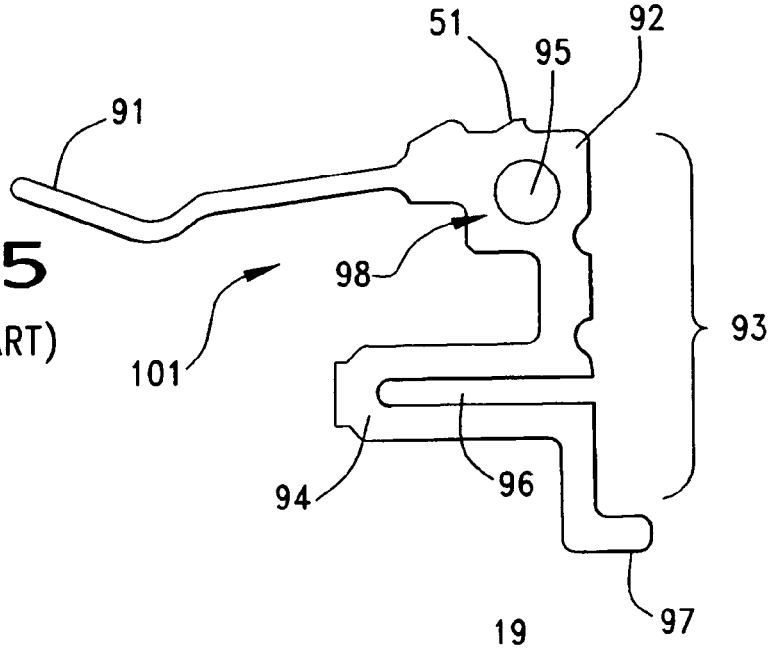
FIG.5 (PRIOR ART)
FIG. 5 is a side elevational view of a second type terminal utilized in the known connector housing of FIG. 3.

FIG. 5 illustrates a terminal 101 used in the second set (or type) of terminals in connectors of the present invention. The terminal 101 includes an elongated, cantilevered contact portion 91, a first (upper) retention section 92 that is also considered to be part of a terminal body portion 93. A second (lower) retention section 94 is also provided and is spaced apart from the first retention section 92. Both retention sections 92, 94 are disposed on the terminal 101 between the contact portion 91 and the mounting, or tail portion, 97.

The first retention portion 92 includes a relatively large central part 98, which has an opening 95 formed therein. This opening is shown as circular and completely enclosed within the terminal retention area and serves to reduce the metal of the terminal and this particular portion thereof and it also reduces the capacitance of the terminal with respect to any adjoining terminal, by reducing the amount of surface area of the terminal. This reduction of material also increases the inductance of the terminal, which also influences the impedance of the terminal. The reduction of capacitance (or increase in inductance) will in turn, as is known, affect the impedance of the terminal, and of the connector overall in the region from the second terminal contact portion 91 to the mounting portion 97 thereof. The second terminal retention portion 94 also has an opening 96 formed therein and this opening 96 takes the form of a slot that preferably extends from an edge and through a portion of the central area of the second terminal retention portion 94. This slot 96 is not completely enclosed in the retention portion 94 as in the top retention portion. The opening 95 is shown as circular, a variety of other shapes, preferably polygon shapes may be used. The size and shape of this first retention portion 92 may be varied in order to vary the impedance of the system.

Figure 6:
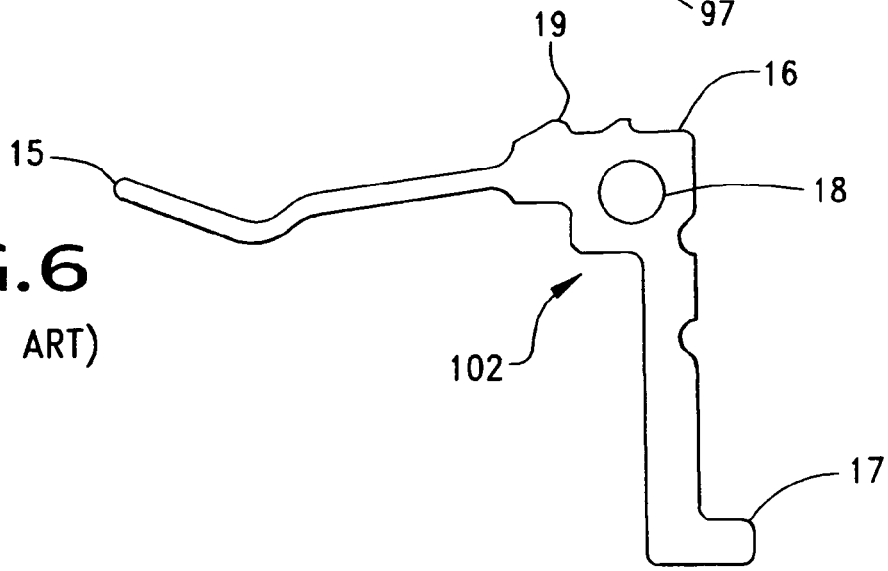
FIG.6 (PRIOR ART)
FIG. 6 is a side elevational view of another style of a second type terminal suitable used in the known connector housing of FIG. 3, illustrating another modification of only a single terminal body portion to reduce the overall surface area thereof.

FIG. 6 illustrates another second-type terminal, where the terminal 102 contains a contact section 15, a single retention section 16, and a board mounting section 17. The retention section 16 of this second terminal 102 also contains an opening 18 therein in which metal has been removed from the stamped terminal 102. In the illustrated embodiment, this central portion is substantially circular, but can also take a variety of shapes. The size and shape of this central portion can be varied in order to vary the impedance of the system. The retention section of the second terminal may contain barbs 19 which are used to embed in the slots of the dielectric housing to provide terminal retention. The size of the board mounting portion 17 may also be varied to provide adequate area for mounting to the printed circuit board, while also being tuned to provide a specific impedance in the terminal.

Figure 8:
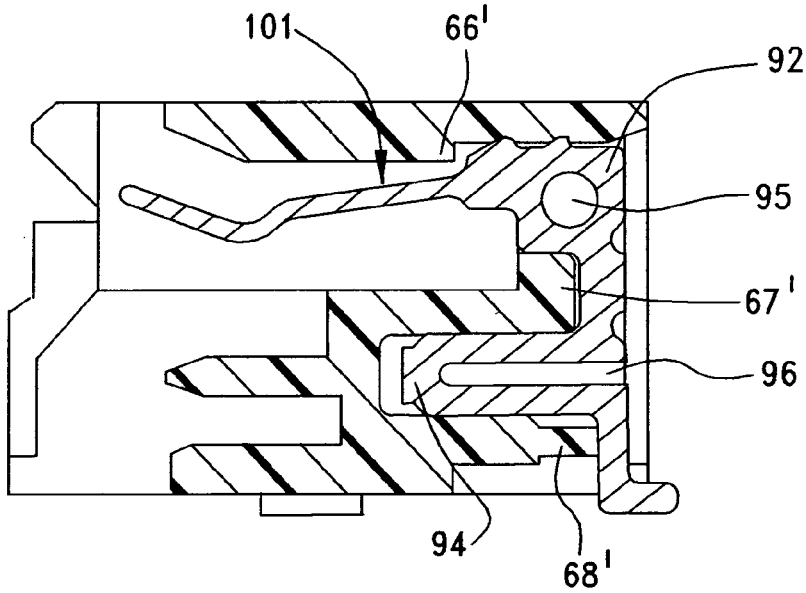
FIG.8 (PRIOR ART)
FIG. 8 is a cross-sectional view of the connector housing of FIG. 3, with a second terminal as shown in FIG. 6, inserted in place within the rear face of the housing.
Figure 9:
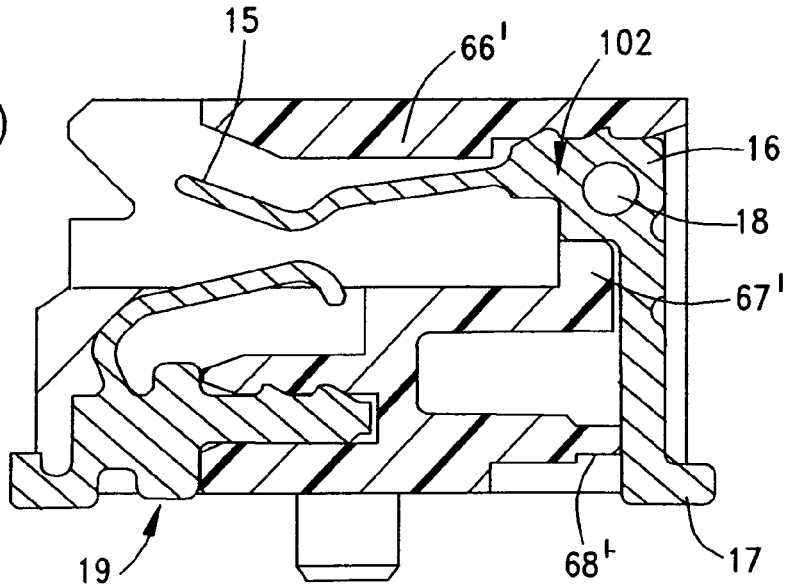
FIG.9 (PRIOR ART)
FIG. 9 is a cross-sectional view of the connector housing of FIG. 3, with a first terminal as shown in FIG. 4 and a second terminal as shown in FIG. 6 inserted therein.

The terminals are easily stamped from sheet metal, but because of the openings 95, 96 formed thereon, a concern is raised about the ability to retain the second terminals 101, 102 within the connector housing 3. This concern is alleviated by modifying the connector housing 3', as illustrated in FIG. 3, in order to provide additional housing material 66', 67' and 68' near the retention slots 90'. The effect of this additional material is shown in FIGS. 8 & 9, where the material 66' and 67' enclose and abut the enlarged terminal first retention portion 92 and in effect, provide additional reaction surfaces against which the retention portions 92, 94 bear. FIG. 9 illustrates how the other second terminal of FIG. 3 is fit into the housings 3' of the invention.

Figure 7:
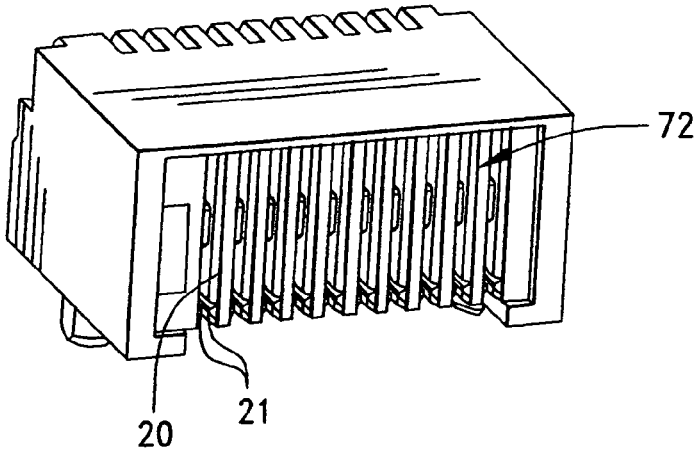
FIG.7 (PRIOR ART)
FIG. 7 is a perspective view of the connector housing of FIG. 3, angled to show the rear face thereof that receives the second set of terminals of FIG. 5 therein.

The length and width of the second retention portion can also be varied in order to vary the surface area of the terminal, and therefore also the impedance. Both first and second retention sections of the second terminal may contain barbs, or teeth 51 which are used to embed the terminals 101 firmly and reliably within the slots 72 of the connector housing 3. The size of the board mounting section may also be varied to provide adequate area for mounting to the printed circuit board, while also being tuned to provide a specific impedance in the terminal. FIG. 7 illustrates the rear face of the connector housing, where each of the terminal receiving slots 72 include a pair of opposing retention bumps 21 disposed on opposite sides of the terminal, for increased terminal retention to the housing.

FIGS. 10-17 illustrate an embodiment of a connector constructed in accordance with the principles of the present invention. In this embodiment, the terminal configuration and arrangement make high speed data signals at speeds of at least approximately 2 gigabits per second and greater up to at least 10 gigabits per second and beyond. It has been found in other connectors, especially those known connectors as exemplified in FIG. 2, that certain structural elements adversely affect the ability to carry high speed signals.

Mostly, it is due to the structure of the connector terminals, and a typical such terminal is shown in FIG. 4, and this terminal 4 is inserted into the connector housing 3 along its front face 6. This terminal 4 and particularly its large body portion 87 and retention portion 8 creates what may be best defined as a large electrical stub when looking at the terminal from a current flow perspective. These areas add capacitance to the overall impedance of such a connector, and thus the front terminal of the connector must act as a low speed terminal. Similarly, but to a lesser degree, the rear terminal 5 with its large retention portion 89 creates an electrical stub. This retention portion 89 and the wide body portion extending between the top retention portion 88 and the surface mount tail 20 also adds capacitance to the overall connector impedance and reduces the speed at which the terminal can transmit clean high-speed electrical signals.

Figure 10:
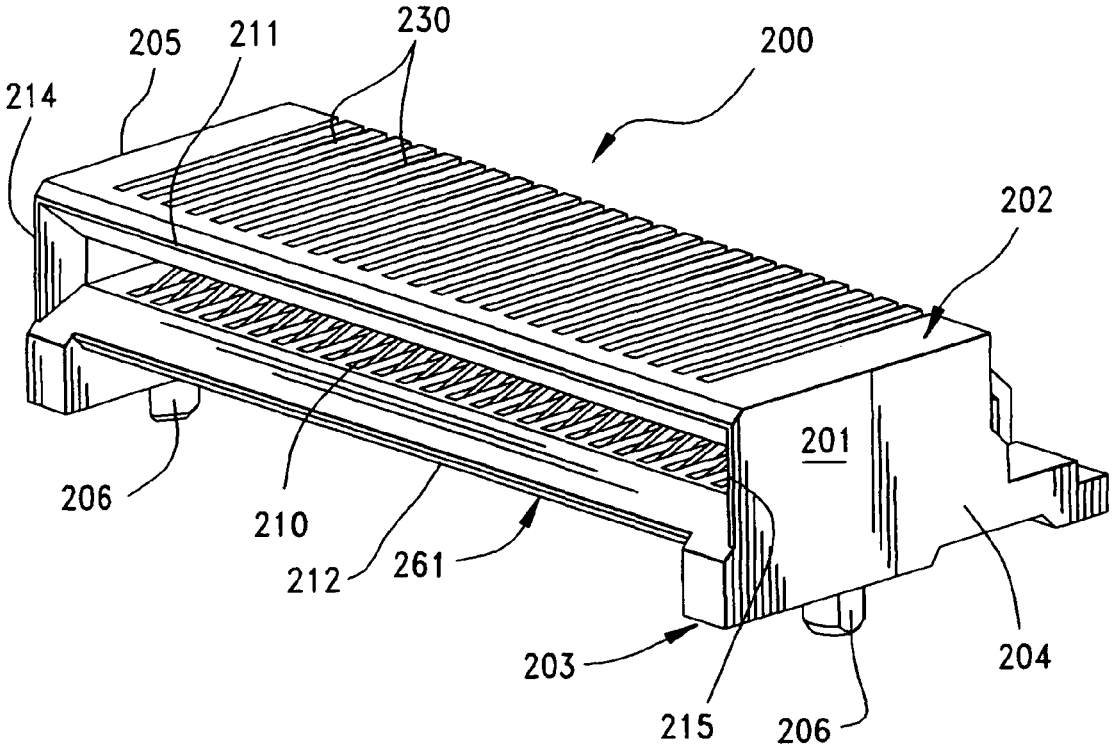
FIG. 10 is a perspective view of a new connector constructed in accordance with the principles of the present invention.
Figure 13:
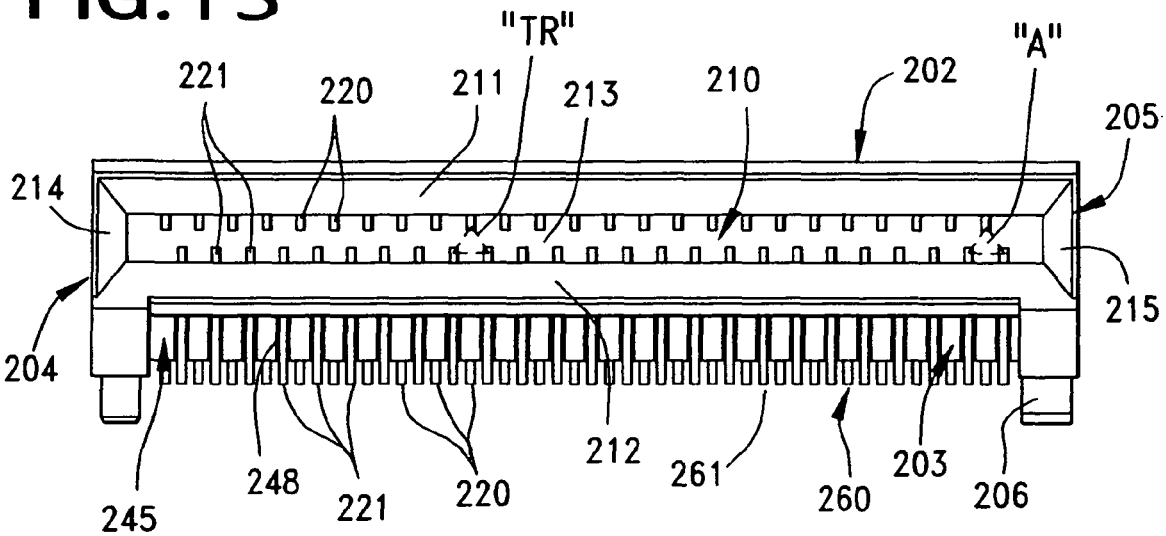
FIG. 13 is a front elevational view of the connector of FIG. 10.

The connectors of the present invention provide the ability to carry high speed data signals of 2 Gbps and greater and approaching approximately 10 GBps. As illustrated in FIG. 10, the connector 200 includes a housing 201 that has a top 202, a bottom 203 and two sides 204, 205. The bottom 203 may include one or more mounting posts 206 that are used to position the connector on a circuit board (not shown). The front of the connector preferably includes a circuit card-receiving slot 210 that receives the leading edge of a circuit card that is typically housed within an electronic module (not shown). As shown in FIGS. 14-17, this slot 210 extends interior of the connector housing 201 and is bounded by a top wall 211, a bottom wall 212, a rear wall 213 and two side walls 214, 215. (FIG. 13.)

The connector 200 includes two distinct sets of thin conductive terminals 220, 221 that extend into the card-receiving slot 210 and which provide an electrical transmission path from circuits on the circuit card to circuits on the larger circuit board. The sets of terminals are similar in that they each include contact portions 225 that extend into the card-receiving slot 210 and tail portions 226 that extend out of the connector housing 201 in opposition to the circuit board to which the connector 200 is mounted. The terminals also include what may be considered as body portions 227 that are disposed intermediate the contact and tail portions 225, 226 and which interconnect them together. For purposes of understanding the structure of the present invention, the body portions 227 are considered to end just after where the terminal retention portions extend away from the terminal body portions. The mounting or tail portions of the terminals begin at the same location. This is shown diagrammatically in FIGS. 14 & 15, wherein "B" is represents the end of extent of the terminal body portions and "M" represents the beginning of the extent of the mounting or tail portions of the terminals.

The terminals of the first, or top set, 220 of terminals are inserted into the connector housing 210 in slots 230 that are formed in the top wall 211 of the housing 201. As shown best in FIG. 14, these top slots include openings 231 that communicate with the card-receiving slot 210 of the housing 201 and are positioned so that the contact portions 225 of the top terminal set 220 may at least partially extend into the slot 210. The terminals of the second, or bottom set 221 of terminals are inserted into the connector housing 210 in slots 235 that are formed in the bottom wall 211 of the connector housing 201. As shown best in FIG. 15, these bottom slots 235 include openings 231 that communicate with the card-receiving slot 210 of the housing 201 and are positioned so that the contact portions 225 of the top terminal set 220 may at least partially extend into the slot 210. The terminal-receiving slots 230, 235, as best illustrated in FIG. 13, are offset from each other so that the slots 235 that hold the bottom set of terminals 221 are preferably arranged so that they are positioned offset from the terminals 220 that occupy the top set of slots 230. In this fashion, a triangular arrangement of groups of terminals may be effected, with three terminals being positioned at respective apexes of imaginary triangles arranged in an inverted order widthwise of the connector.

The terminals each further preferably include retention portions 229 (shown as stubs) that primarily serve to retain the terminals in place within the connector housing 201. As illustrated, these terminal retention portions 229 extend at an angle away from the body portions of the terminals and into additional cavities 240 that are formed in the housing 201, and which may be formed, as shown, in the rear wall 212 of the connector housing 201. These additional cavities are offset as between the top and bottom sets 220, 221 of terminals, so that the retention portions 229 of the two terminal sets 220, 221 that are received therein extend toward each other. The free ends 229*a* of the retention portions are preferably spaced from each other a preselected distance so as to minimize capacitive coupling therebetween.

These retention portions 229 support the terminals 220, 221 in a cantilevered fashion, and the terminal slots 210, 211 may be provided with angled faces 241, 242 that extend toward the card-receiving slot 210 and the slot openings 230, 235. In this manner, the contact portions 225 of each of the terminals of the two terminal sets 220, 221 extends in a cantilevered fashion into the card-receiving slot 210. These angled surfaces 241, 242 also serve as reaction surfaces against which the terminals 220, 221 may be bear if the terminal are stitched in the connector housing 201, which would normally occur if the terminals tail portions were of the through hole type (as illustrated in phantom in FIGS. 14-16).

In order to achieve a close terminal to terminal spacing within the card-receiving slot 210, the bottom set 221 of terminals is preferably inserted from the bottom of the connector housing 201. This is achieved without the connector housing losing any significant structural integrity. The main retention of the terminals 220, 221 occurs along the terminal tail holding area 246, the slots in the top of the rear face of the connector housing and secondary retention is provided by the terminal slots 230, 235.

Figure 14:
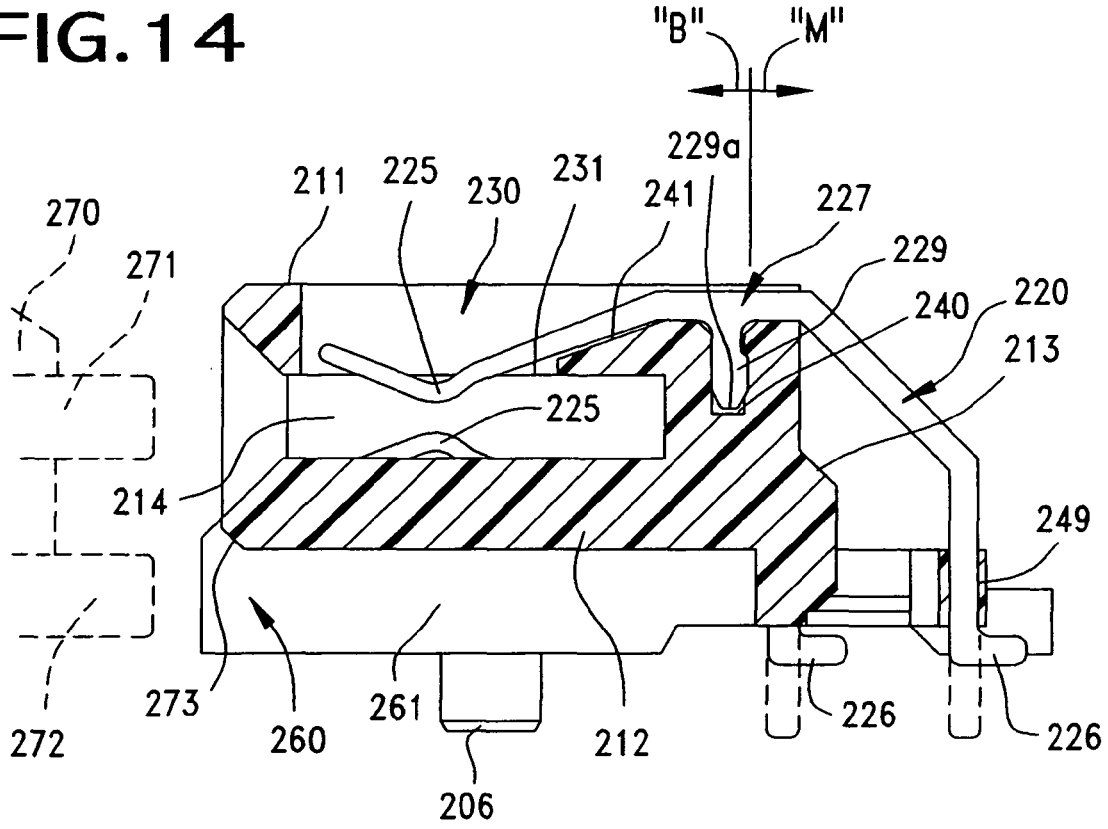
FIG. 14 is a cross-sectional view of the connector of FIG. 10 taken along a line that exposes to view one terminal of the top terminal set of the connector and illustrating its manner of engagement with the connector housing.
Figure 15:
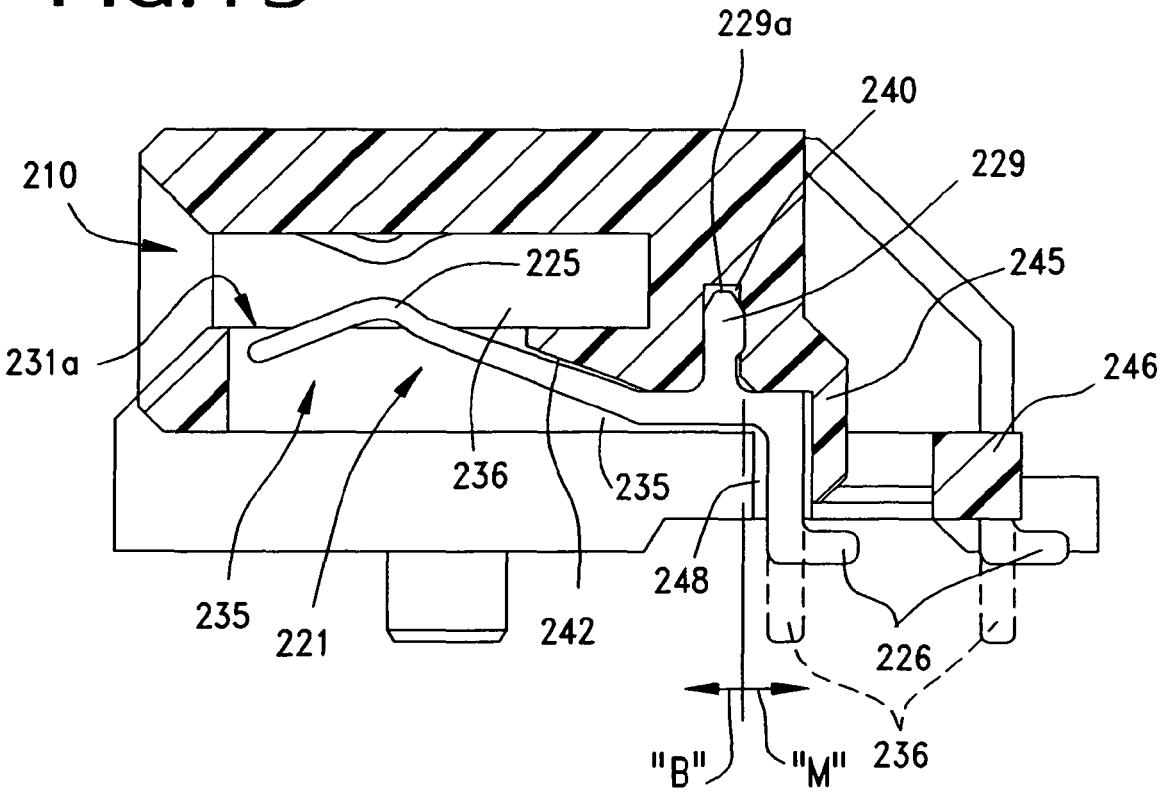
FIG. 15 is a cross-sectional view of the connector of FIG. 10 taken along a line that exposes to view one terminal of the bottom terminal set of the connector and illustrating its manner of engagement with the connector housing.
Figure 16:
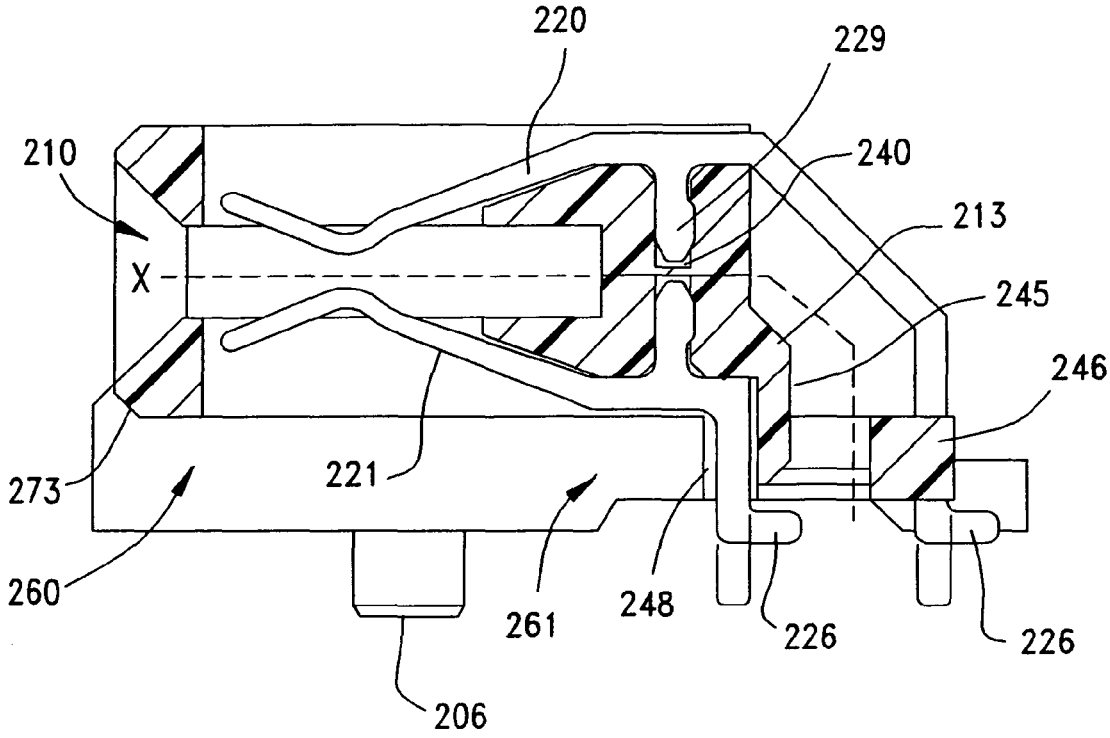
FIG. 16 is a staggered cross-sectional view of the connector of FIG. 10 taken along a line that exposes to view one terminal of each of the top and bottom terminal sets of the connector and illustrating their manner of engagement with the connector housing.

Although terminal tail portions 226 of the surface mount type are described in detail herein, it will be understood that the connectors of the present invention may also utilize terminals having tail portions of the through hole type 236 as shown in phantom in FIGS. 14-16. Whatever the type of tail portions used for the terminals, it is desired to hold them in position with respect to each other. Rather than employ a separate tail alignment element, the present invention utilizes two different areas of the bottom side 203 of the connector housing 201 to hold the terminal tails 226 in place in a spaced-apart arrangement. The terminal tails 226 are spaced apart from each other lengthwise of the connector 200 and the tails 226, as illustrated in the Figures, are spaced apart along two tail alignment or holding areas 245, 246.

Figure 12:
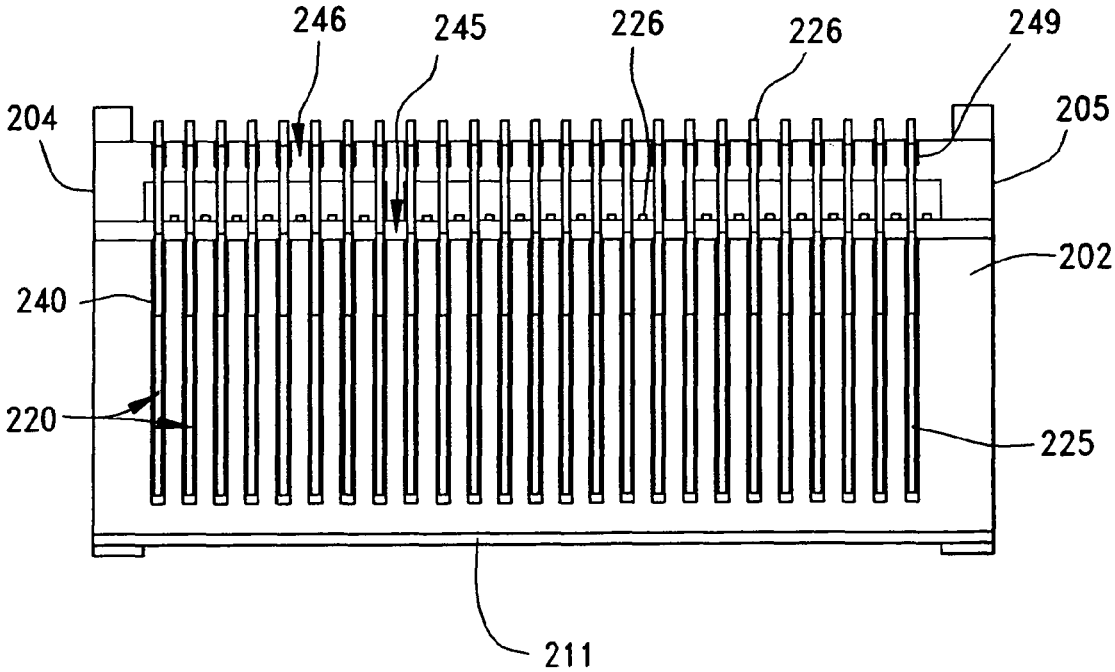
FIG. 12 is a top plan view of the connector of FIG. 10.
Figure 11:
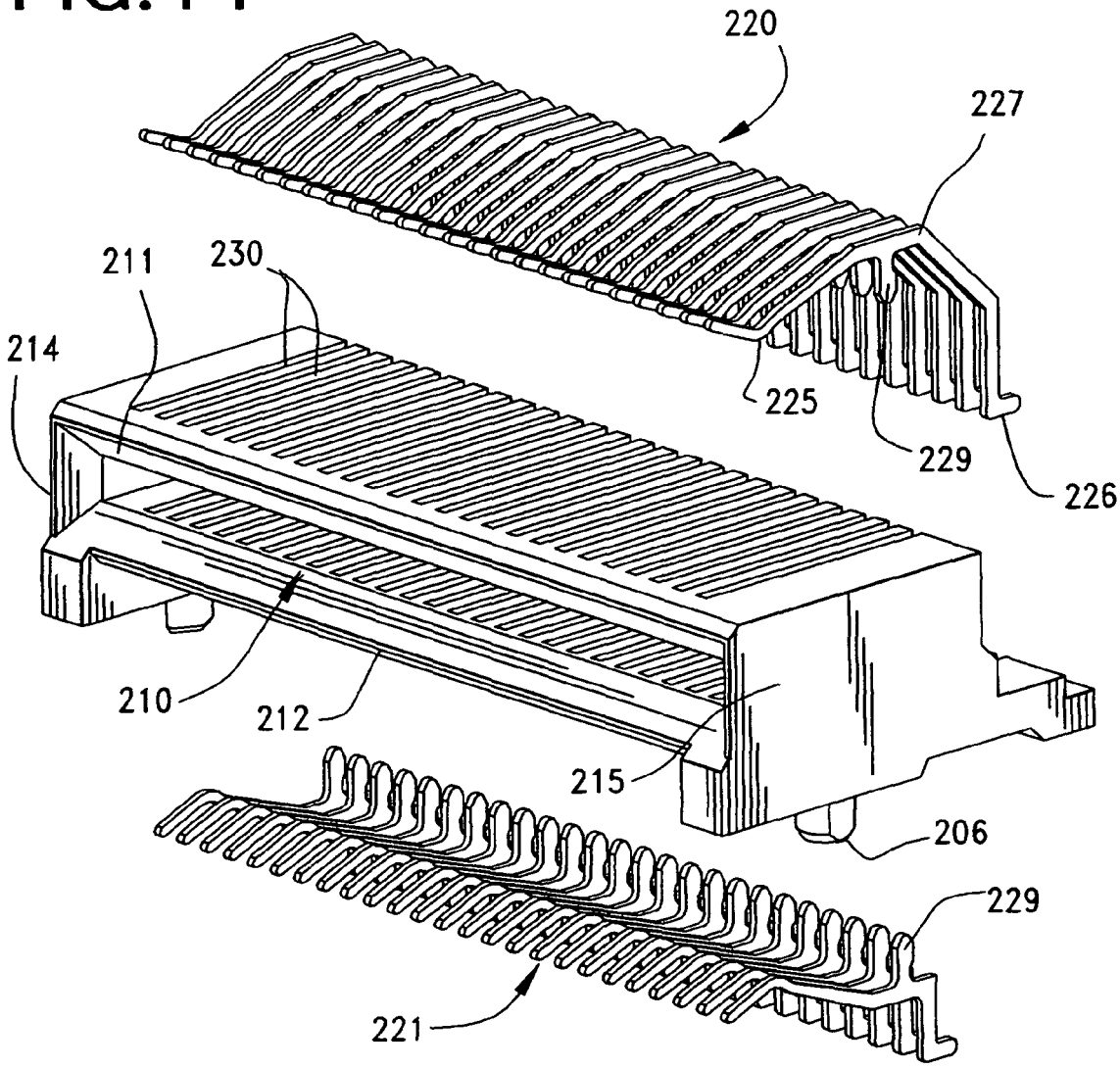
FIG. 11 is an exploded view of the connector of FIG. 10.

Also, as illustrated in FIGS. 12 and 14, the tail portions of the two sets of terminals are provided in two different dielectric mediums so as to further influence coupling between the terminals. As shown, the bottom set of terminals 221 have their tail portions enclosed within slots formed in the bottom of the connector housing. The effect of this is to provide a dielectric medium of the housing material between adjacent tail portions of those terminals. The tail portions of the top set of terminal 220 are seen to be substantially supported with only air as the dielectric medium between them.

As such, different coupling between the adjacent tail portions of the top and bottom terminal sets may be obtained, permitting the impedance of the connectors of the invention to be more finely tuned in the tail portion areas. The shorter length terminals, i.e., the bottom terminals, are enclosed in the plastic of the housing, while the longer length terminal, i.e., the top terminals, are enclosed in air. This also permits the connector tail portions to be visually inspected during and after the connectors are soldered to a circuit board. Another impedance tuning aspect is obtained by the arrangement of the two sets of terminal tail portions. The vertical center lines of the tail portions of the bottom set of terminals is spaced a first distance away (behind) from the vertical centerline of the bottom terminal retention portions and the vertical center lines of the tail portions of the top terminals are spaced a second distance from the vertical centerline of the top terminal retention portions that is greater than the first distance. Typically, this second distance will be twice that of the first distance.

These areas include a plurality of tail slots 248, 249, with one set of the slots 248 being arranged so that they face the front of the connector, and the other set of slots being arranged so that they face the rear of the connector 200. The slots 248 also open to the bottom of the connector as shown best in FIGS. 13 & 15, while the slots 249 open to the top of the connector as best shown in FIGS. 12 & 14. It can be seen from FIG. 16 that the terminals 220, 221 of the two terminal sets exhibit a measure of symmetry in that they are generally spaced-apart from each other a common distance along a center dividing axis shown in dashed line at X-X. Additionally, the retention portions 229 of each of the terminal sets 220, 221 extend toward each other and are of a small size, so that their stub nature does not create a large impedance discontinuity in this area of the connector terminals so that the impedance may be controlled along the extent of the terminals through the connector housing. The use of this symmetry permits the use of high speed terminals in an application that has size constraints.

It will be understood that the structure of the present invention provides unique advantages. The tail portions of the terminals near the bottom portion of the connector housing serve to anchor the terminals when an opposing mating blade or card is inserted into the connector. It can be seen that the tail portions of the top set of terminals will undergo compression as the free ends of the contact portions of the top terminals 220 are moved upwardly, causing a moment around the top terminal retention portions 229. Similarly, insertion of a card or blade into the connector slot causes the contact portions of the bottom set of terminals to move downwardly, applying a moment around the bottom terminal retention portions 229. This exerts a tensile force on the tail portions of the bottom set 221 of terminals. The application of these two different and opposing forces, reduces any concern that repeated insertions and removals of the mating connector will adversely apply any detrimental torsional forces to the terminal tail portions.

Figure 17:
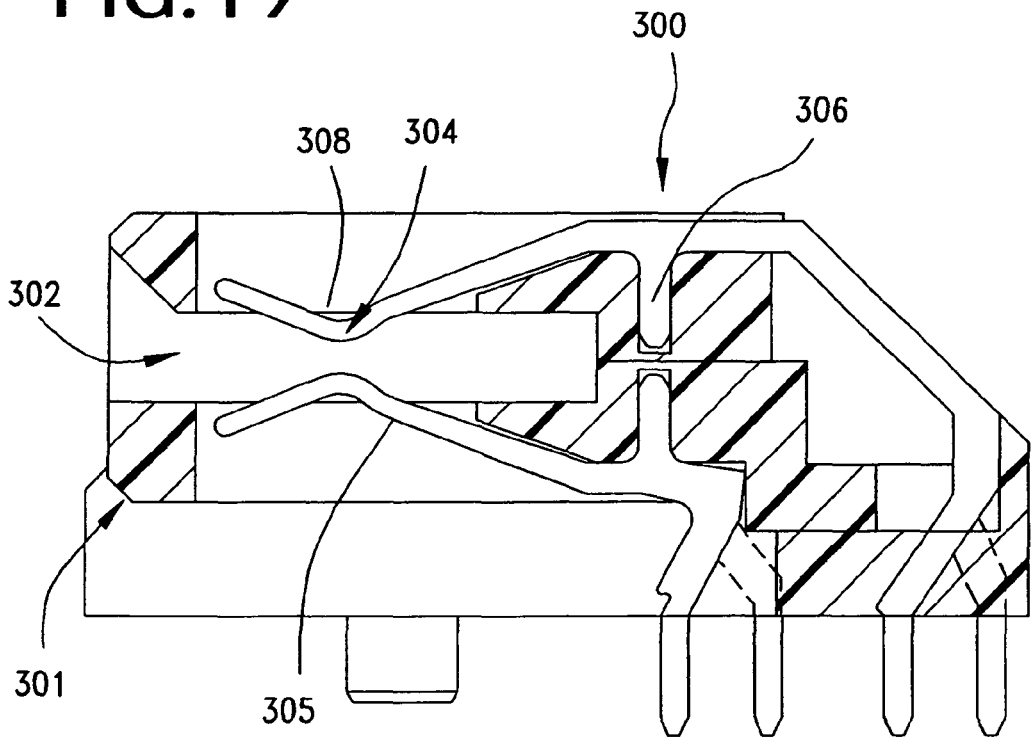
FIG. 17 is a cross-sectional view of an alternate embodiment of a high speed SFP-style connector which has terminal configurations that are best suited for through hole mounting applications.

Turning now to FIG. 17, a through-hole embodiment 300 is illustrated in cross-section. As shown, this embodiment 300 has an insulative housing 301 with a card slot 302 that extends width wise across the face 303 of the connector housing 301. Two sets of terminals 304, 305 are utilized and are inserted into the connector housing from the top and bottom surfaces thereof as in the connector 200. The terminals have retention portions 306 that fit into cavities to retain the terminals in place and to provide a reaction surface for the cantilevered terminal contact portions 308. The tail portions 309 of the terminals 394, 305 are angled and offset as shown to provide the through hole feature. A thin web of housing material separates the top and bottom terminals as shown.

Figure 18:
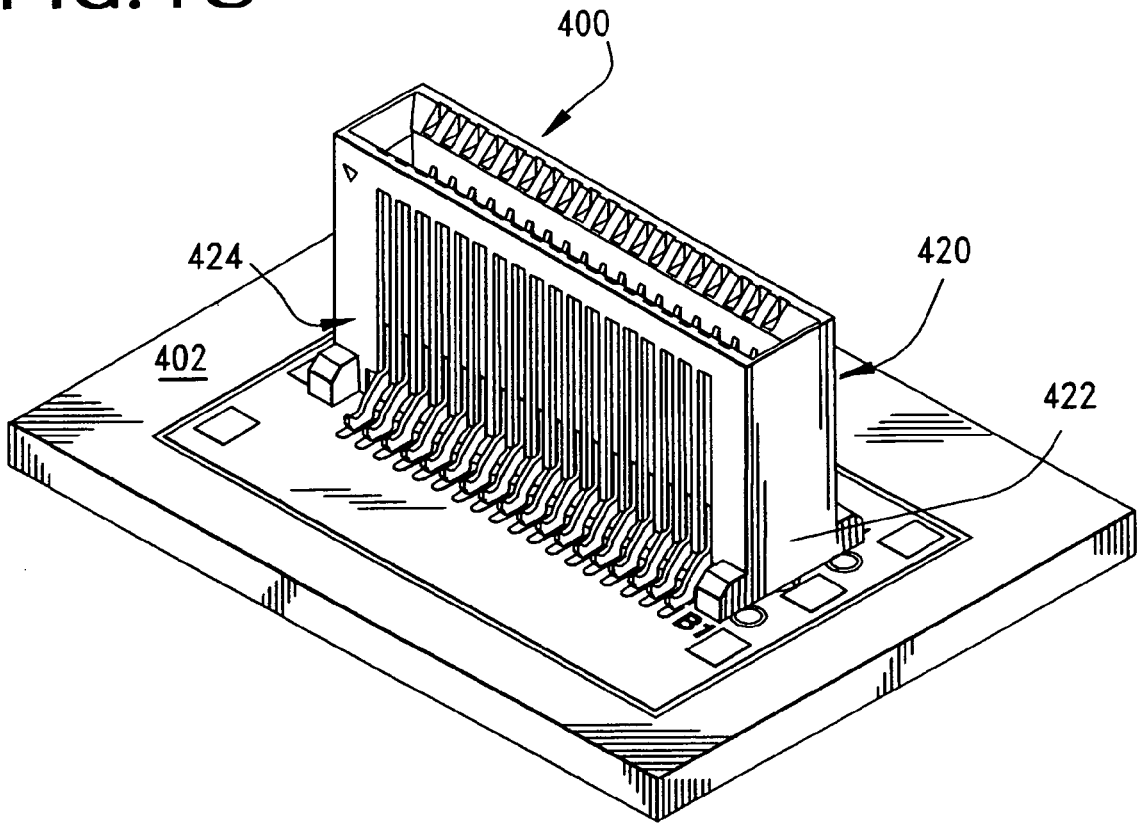
FIG. 18 is a perspective view of an assembly incorporating a vertical embodiment of a connector constructed in accordance with the principles of the present invention.
Figure 20:
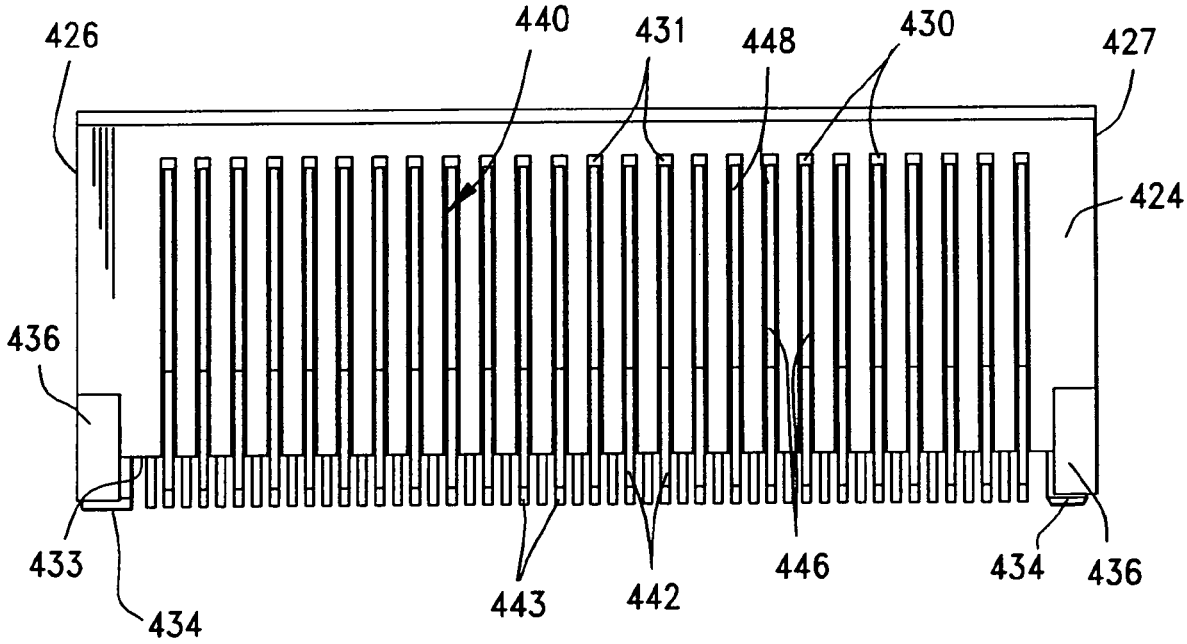
FIG. 20 is a side elevational view of the connector of FIG. 19.

FIG. 18 illustrates another embodiment of a connector constructed in accordance with the principles of the present invention. In this embodiment, the connector 400 has a vertical format and receives a plug connector of the type described above. The connector 400 may be mounted in a vertical orientation to a supporting base circuit board 402 and it may be surrounded by a conductive shield (not shown).

Figure 19:
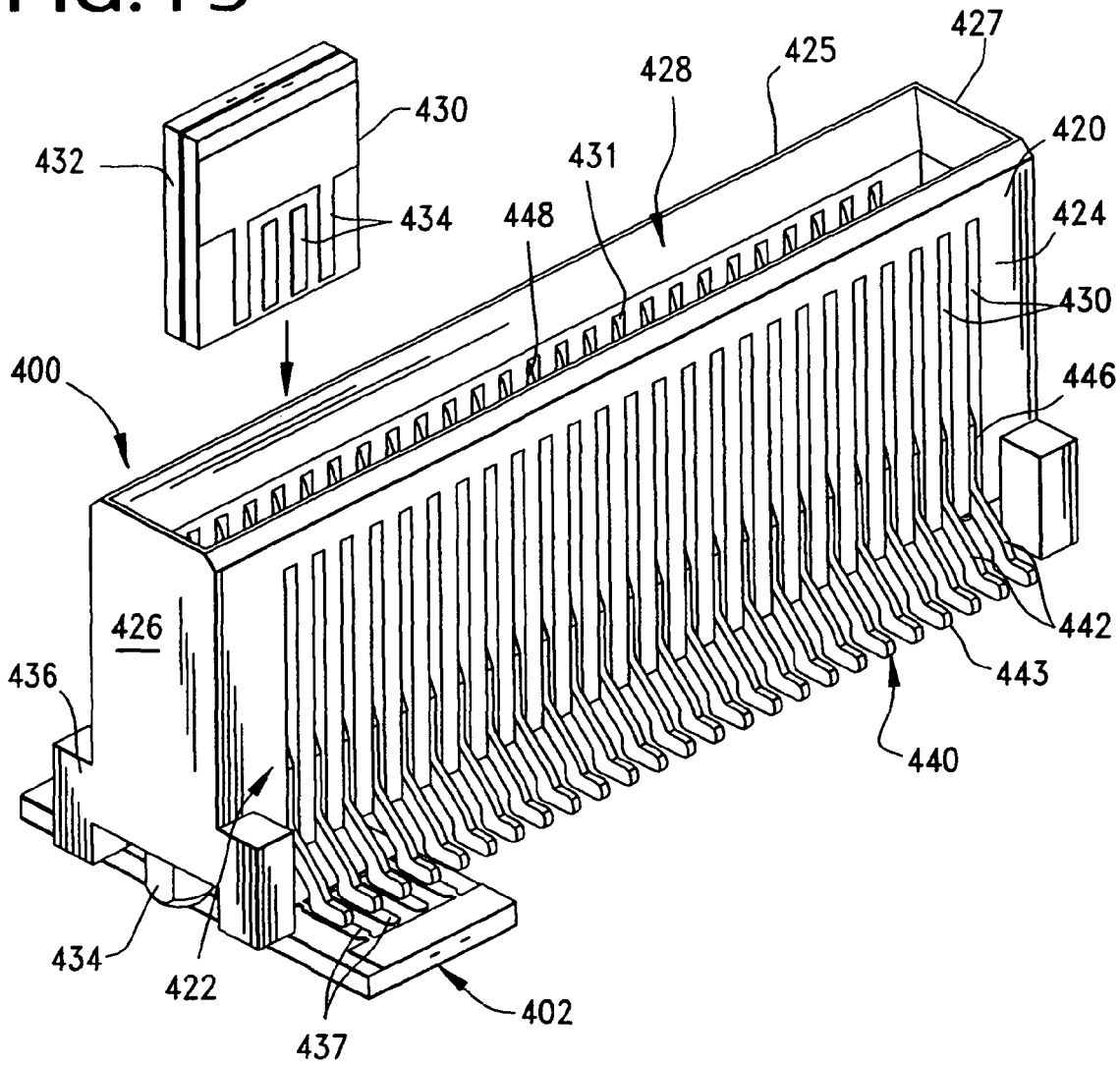
FIG. 19 is the same view as FIG. 18, but with most of the supporting base circuit board removed for clarity and with a portion of a plug connector circuit card shown in alignment with the card-receiving slot of the connector.

The connector 400 includes an insulative housing 420 that has a body portion 422 with two sidewalls 424, 425 that extend widthwise of the connector 400 and which are interconnected by two end walls 426, 427. The side and end walls cooperatively define an interior slot 428 of the connector 400 that receives, in operation, a projecting mating blade 430 of an opposing mating plug connector (not shown). In FIG. 19, this mating blade 430 is illustrated preferably, as a circuit card 432 that has conductive traces 434 disposed on one or more of its surfaces. Preferably, the card-receiving slot 428 has a length that matches that of the circuit card 430.

The connector 400 includes a plurality of vertical cavities 430 that are formed in the side walls 424, 425 and which extend for most of the height of the connector housing 420. As shown best in FIG. 22, these cavities 430 communicate with the card-receiving slot 428 along the upper extent of both the slot 428 and the cavities 430 by way of passages 431 disposed on the side walls 424, 425. The cavities 430 also preferably include third cavities in the form of recesses or sub-cavities 432 that extend in the body of the connector housing 420 underneath and spaced apart from the card-receiving slot 428. As illustrated, these sub-cavities 432 extend at an angle to the card-receiving slot 428 and the terminal-receiving cavities 430. In the preferred embodiment of the invention, it is desirable that the sub-cavities 432 are arranged perpendicular to the slot and cavities 428, 430.

Figure 21:
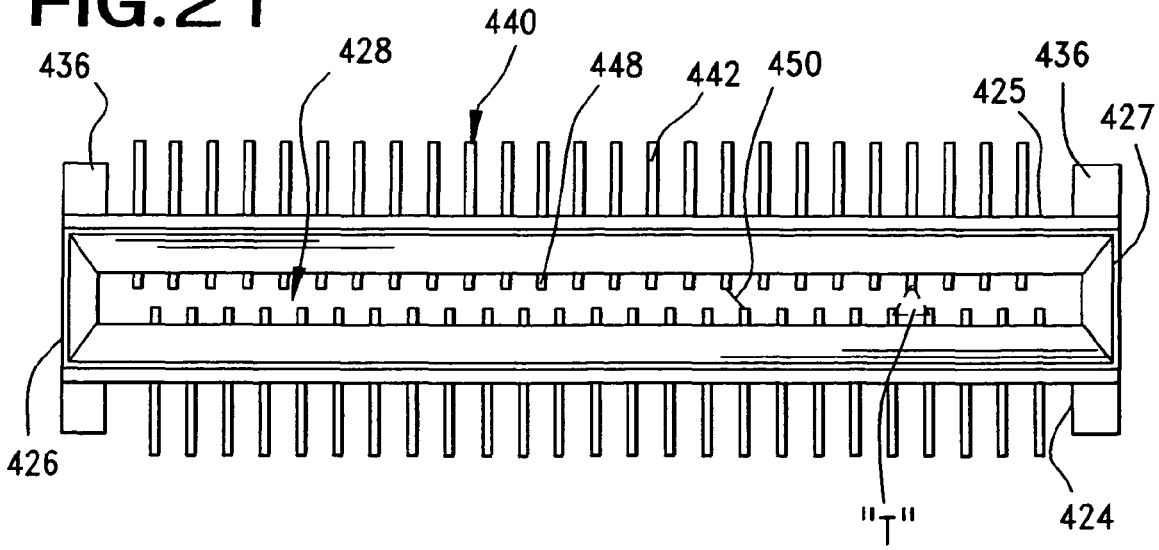
FIG. 21 is a top plan view of the connector of FIG. 19.

The connector 400 also has a bottom surface 433 that is maintained in opposition to the circuit board 402 by mounting posts 434 and/or standoffs 436. The terminal-receiving cavities 430 may be arranged, as illustrated, in two sets or arrays, which extend widthwise respectively along the side walls 424, 425 of the connector 400. The cavities are further spaced apart from each other a preselected distance that should be equal to the pitch between adjacent terminals inserted into the cavities 430. The two sets of cavities 430 are offset from each other, meaning the cavities on one side of the connector (for the first set of terminals) are spaced apart from each other by a pitch distance P, and the terminals on the other side of the connector (for the second set of terminals) are also preferably spaced apart from each other the same pitch P but their center lines are offset from the center lines of the first set of cavities. In this offset fashion, the terminal contact portions will contact the offset traces on the circuit card inserted into the card-receiving slot of the connector housing. The cavities 430, as shown best in FIG. 22, open to the bottom surface 433 of the connector 400. The top edge of the side and end walls may be chamfered or angled as shown in FIG. 21 in order to provide lead-in surfaces for the mating blade of the opposing plug connector. Each cavity 430, receives a single conductive terminal 440. This offset is useful in maintaining the maximum density of terminals in the connector housing 402 and, in instances where differential signals are carried through the terminals 440 of the connectors 400 of the invention, the terminals, when viewed from the top of the card-receiving slot 428 may be arranged at the apices of imaginary triangles, as shown by the dotted lines T in FIG. 21.

The side profile of the preferred structure of the terminals 440 is illustrated best in FIG. 22. Each terminal 440 can be seen to have a tail portion 442 that extends out of the connector housing and in the vertical embodiment, through the bottom surface 433 of the connector 400. The terminal tail portion 442 may end in a surface mount foot 443 as shown for mounting to a trace 437 of the circuit board 402, or it may have a through hole tail 444 that extends through a suitable hole formed in the circuit board 402. A terminal body portion 446 is provided that interconnects either of the tail portions 443, 444 to a contact portion 448 that extends upwardly and inwardly from the body portion 446. The contact portion 448 has a free end 449 that extends into passage 431 and further preferably includes a bend or radius 450 that projects into the card-receiving slot 428. In this manner, as shown in the drawings, the contact portions 448 of the terminal 440 are in effect, vertically cantilevered in the connector housing 402.

Importantly, the terminals 440 include retention portions 452 in the form of segments that extend, as illustrated, at angles from the body portions 446. These retention portions 452 extend preferably perpendicular to the body portions 452 and the extent of the contact portions 448 so that the contact portions extend vertically and the retention portions 452 extend horizontally. The retention portions 452 are received within the sub-cavities 432 and they extend for the preselected distance D. It is preferred that the retention portions 452 have lengths that do not extend past the centerline of the card-receiving slot 428 so as not to weaken the body portion 460 of the connector housing 402 beneath the card-receiving slot 428. The retention portions 452 of the terminals 440 are preferably larger in size than the sub-cavities 432 in order to provide an interference fit.

The connector housing body portion 460 houses the bottom portions of the terminal-receiving cavities 430 and the body portion 460 includes what are best described as L-shaped segments 462, each having an angled wall 463. One of these segments is associated with each of the connector terminals. The angled wall 463 rises up in the cavity and serves as a stop to limit the inward extent of the terminal body and contact portions during use. It also increases the strength of the cavity and the bearing wall portion 464 that is located between the angled surface 463 and the terminal retention sub-cavity 432.

FIG. 23 illustrates another embodiment of a terminal 440*a* that is suitable for use in vertical connectors of the present invention. The terminal has the same contact, body, retention and tail portions as described above with the previously used reference numbers. The retention portion 452 includes an enlarged head portion 470 with a skiving edge 472 disposed along its bottom edge for embedding into the plastic material of the connector housing body portion 460. A reentrant, or open portion, 474 may also be provided at the location where the retention portion 452 meets the terminal body portion 446 in order to reduce the contact area of the terminal. Preferably, one or two forward faces 475 are defined along the front edge 476 of the terminal retention portion 452 and they may be cut at a 45 degree angle as shown. These angled faces 475 ensure that the retention portion 452 obtains maximum retention within the connector housing and they reduce the amount of metal in the retention portions 452 to minimize any impedance discontinuities that may occur in this section of the connector as compared with a flat-ended retention portion. A short barb or skiving edge is preferably provided on terminals of this design in order to get a desired impedance by minimizing discontinuities yet while providing maximum terminal retention. FIG. 24 illustrates this terminal 440*a* in place within the connector housing 402. This skiving edge assists in providing an interference fit between the terminals and the connector housing.

The reentrant portion 464 is also shown in the terminal depicted in FIG. 23, albeit of a smaller size and this portion reduces the contact area between the terminal body portion and the connector housing body portion so that most of the terminal retention is provided by the retention portion. Likewise, the bending forces that are applied to the terminal when the circuit card is inserted into the connector housing card-receiving slot and the contact portions are flexed outwardly from the slot, are carried mostly by the terminal retention portions.

While the preferred embodiment of the invention have been shown and described, it will be apparent to those skilled in the art that changes and modifications may be made therein without departing from the spirit of the invention, the scope of which is defined by the appended claims.

The invention claimed is:

1. A vertical connector for providing a connection between a circuit board and an opposing electronic element, the opposing electronic element including a male portion having a plurality of conductive members disposed thereon, comprising:

an insulative connector housing having a mating face including a receptacle portion for receiving the male portion of the opposing electronic element and a mounting portion for mounting the connector housing to said circuit board, the connector housing including at least first and second sidewalls, the receptacle portion being disposed between the first and second sidewalls, the first and second sidewalls each respectively including a plurality of first and second vertical cavities;

a plurality of conductive terminals supported by the housing, the plurality of terminals being arranged in distinct sets of first and second terminals in the first and second connector housing sidewalls, each of the terminals in the first and second sets of terminals including a contact portion extending into the receptacle portion for contacting a corresponding conductive member of the opposing electronic element inserted into the receptacle portion, a tail portion for mounting the terminals to a circuit board, and a body portion interconnecting the terminal contact and tail portion together, the tail portion of the first and second set of terminals extending out of the respective first and second cavities to locations exterior of the first and second sidewall, wherein the first set of terminals is arranged such that the adjacent terminal contacts form a single substantially continuous row; and, a retention portion on each of the plurality of terminals for interferingly engaging the connector housing, the retention portion being disposed between the terminal contact and terminal tail portion and the retention portion of the first and second set of terminals extending into the connector housing respectively from opposite sides of the connector housing, the retention portion being configured to reduce impedance discontinuities in the terminals so as to enable transmission of data signals at a data rate of at least two (2) gigabits per second.

2. The connector of claim 1, wherein the retention portion is are configured to extend from the terminal on one side so as to reduce impendence discontinuities.

3. The connector of claim 1, wherein each retention portion is configured so that the impedance discontinuity of the terminals is reduced so as to allow the terminals to transmit data signals at a data rate of greater than five (5) gigabits per second.

4. The connector of claim 1, wherein the first cavities are offset from the second cavities so that the contact portions of the terminals of the first terminal set are offset from the contact portions of the terminals of the second terminal set when the connector is viewed from the mating face.

5. The connector of claim 4, wherein each of the first and second cavities includes a third cavity, the third cavities extending at an angle to the first and second cavities, the third cavities receiving the retention portions of the terminals therein.

6. The connector of claim 5, wherein the connector housing includes a body portion disposed beneath the receptacle portion, and the third cavities extend into the connector housing body portion no more than one half of a width of the connector housing body portion.

7. The connector of claim 1, wherein the first and second cavities communicate with the receptacle portion and each of the first and second cavities includes an angled reaction surface that opposes the body portions of terminals inserted into the cavities.

8. The connector of claim 1, wherein the retention portions have a length that does not exceed one-half a thickness of the connector housing body portion.

9. The connector of claim 1, wherein the terminal tail portions include surface mount tails.

10. The connector of claim 1, wherein the terminal tail portions include through hole tails.

11. The connector of claim 1, wherein the terminals transmit data via a differential signal.

12. A vertical connector, comprising:

a connector housing having a mating face including a receptacle portion for receiving the male portion of an opposing electronic element, and a mounting portion for mounting the connector housing to the circuit board, the connector housing including at least first and second sidewalls, the receptacle portion being disposed between the first and second sidewalls, the first and second sidewalls each respectively including a plurality of first and second vertical cavities;

a plurality of conductive terminals supported by the housing, the terminals being arranged in distinct sets of first and second terminals, respectively, in the first and second connector housing sidewalls, the first and second terminals including contact portions extending into the receptacle portion for contacting the opposing electronic element inserted into the receptacle portion, tail portions for mounting the terminals to a circuit board, body portions interconnecting the terminal contact and tail portions together, the tail portions of the first and second terminal extending out of the connector housing to locations exterior of the first and second sidewall, wherein the first set of terminals is arranged such that the adjacent terminal contacts form a single substantially continuous row; and, a single retention portion for interferingly engaging the connector housing provided on each terminal in the first and second set of terminals, the retention portion being disposed between the terminal contact and terminal tail portion and the retention portion of the first and second set of terminals extending into the connector housing, wherein the terminal retention portion is configured to reduce an impedance discontinuity on the terminal so that the terminals can transmit data signals at a data rate of at least 2 gigabits per second.

13. The connector of claim 12, wherein the terminal tail portions include surface mount tails.

14. The connector of claim 12, wherein the terminal tail portions include through hole tails.

15. The connector of claim 12, wherein each retention portion is configured so that the impedance discontinuity of the terminals is reduced so as to allow the terminals to transmit data signals at a data rate of greater than five (5) gigabits per second.

16. The connector of claim 12, wherein the terminals transmit data via a differential signal.

* * * * *